US010252733B1

(12) United States Patent
Tavares et al.

(10) Patent No.: US 10,252,733 B1
(45) Date of Patent: Apr. 9, 2019

(54) LIGHTWEIGHT FATIGUE RESISTANT RAILCAR TRUCK, SIDEFRAME AND BOLSTER

(71) Applicant: Pennsy Corporation, West Chester, PA (US)

(72) Inventors: Manuel Tavares, Doylestown, PA (US); Aaron Stern, West Chester, PA (US); Michael J. Schmidt, Norristown, PA (US)

(73) Assignee: Pennsy Corporation, West Chester, PA (US)

( * ) Notice: Subject to any disclaimer, the term of this patent is extended or adjusted under 35 U.S.C. 154(b) by 402 days.

(21) Appl. No.: 14/930,145

(22) Filed: Nov. 2, 2015

Related U.S. Application Data

(63) Continuation-in-part of application No. 13/678,087, filed on Nov. 15, 2012.

(51) Int. Cl.
*B61F 5/52* (2006.01)
*C22C 37/08* (2006.01)
*C22C 37/10* (2006.01)

(52) U.S. Cl.
CPC ..... *B61F 5/52* (2013.01); *C22C 37/08* (2013.01); *C22C 37/10* (2013.01)

(58) Field of Classification Search
CPC ..... B61F 5/52; C22C 37/08; C22C 37/10; C21D 5/00; C21D 9/00
See application file for complete search history.

(56) References Cited

U.S. PATENT DOCUMENTS 2,186,008 A 1/1940 Chapman
2,930,329 A 3/1960 Bush
3,000,330 A 9/1961 Shafer
(Continued)

FOREIGN PATENT DOCUMENTS

EP 0232042 A2 1/1986
WO WO/2006072663 A2 7/2006

OTHER PUBLICATIONS

Brandenberg, Kristin; "Successfully Machining Austempered Ductile Iron (ADI)"; Applied Process Inc. Technologies Div.—Livonia, Michigan, USA; Oct. 2001.
(Continued)

*Primary Examiner* — Mark T Le
(74) *Attorney, Agent, or Firm* — Bonini IP Law, LLC; Frank J. Bonini, Jr.

(57) ABSTRACT

The sideframe and bolster of a railway car truck are constructed such that basic overall sideframe and bolster appearance is maintained, but the actual material it is constructed of is changed. The material used is changed from cast steel to an austempered metal, such as, cast austempered ductile iron; whereas cast iron has a density, 0.26 lbs/in^3, which is approximately 8% less than steel, 0.283 lbs/in^3. This immediately allows for a reduction in weight. A second benefit is that iron is easier to pour than steel and actually increases in volume, slightly, as metal cools compared to steel which shrinks. Efficient use of materials is improved, meaning less metal is used to make the same final shape, as a way of reducing the sideframe and bolster weight. Both factures combined allow for a lighter weight railway car truck, sideframe and bolster, while utilizing standard designs.

61 Claims, 3 Drawing Sheets

(56) References Cited

U.S. PATENT DOCUMENTS

| | | | | |
|---|---|---|---|---|
| 3,754,514 | A | 8/1973 | Peterson | |
| 4,424,750 | A | 1/1984 | Tilly et al. | |
| 4,737,199 | A * | 4/1988 | Kovacs | C21D 5/00 148/321 |
| 5,410,968 | A | 5/1995 | Hawthorne et al. | |
| 5,481,986 | A | 1/1996 | Spencer et al. | |
| 5,878,897 | A | 3/1999 | Lazzaro et al. | |
| 5,900,082 | A * | 5/1999 | Hewitt | C21D 1/185 148/320 |
| 6,173,655 | B1 * | 1/2001 | Hawthorne | B61F 5/12 105/182.1 |
| 6,796,448 | B1 * | 9/2004 | Wilt | B61G 7/10 213/40 R |
| 2010/0294452 | A1 | 11/2010 | Berthelet | |

OTHER PUBLICATIONS

A. Kahn and B.K. Chen, "Evaluation of Grade 1 Austempered Ductile Iron for Application to Rail Cast Components", Proceedings of the Fifth Asia Pacific Industrial Engineering a.

Luís Magalhães, Jorge Seabra, "Teeth Surface Failures in Austempered Ductile Iron (ADI) Gears", Gears and Transmission Workshop, Paper No. XIII, p. 269-286, Faculdade de Engen.

Stokes B. et al.; "Effects of Carbides on Fatigue Characteristics of Austempered Ductile Iron", Metallurgical and Materials Transactions A, 36 (2005) 977-988.

Bubenko et al.; "Fatigue Crack Propagation through Austempered Ductile Iron Microstructure"; Materials Engineering, vol. 17, 2010, No. 3, p. 15-20.

Bubenko et al.; "Fatigue Crack Propagation Within the Austempered Ductile Iron Microstructure"; Acta Metallurgica Slovaca, vol. 17, 2011, No. 1, p. 18-25.

Dundar, Sacit; "Application of Austempered Ductile Iron to Rail Wheel Sets"; Journal of Engineering Sciences 2003, 9 (3), p. 283-287.

International ADI and Simulation Conference; May 28-30, 1997.

Knuckles, Types E and F—Fatigue Test, AAR Manual of Standards and Recommended Practices Castings, 2009, [M-216] 1-2.

Keough J. R., et al.; "Continuing Developments in the Science and Application of Austempered Ductile Iron (ADI)"; 2012.

AAR Manual of Standards and Recommended Practices Casting Details; Castings, Steel; Specification M-201; S [M-201] 41—S [M-201] 49.

AAR Manual of Standards and Recommended Practices Casting Details; S [M-211] 143—S [M-211] 149.

AAR Manual of Standards and Recommended Practices Casting Details; Coupling Systems; Specification M-215; S [M-215] 337—S [M-215] 342.

"The Six Standard ADI Grades Per ASTM A897/A897M-06"; www.appliedprocess.com; Issued Nov. 4, 2008.

AAR Manual of Standards and Recommended Practices Casting Details; Truck Bolsters, Cast or Structural—Design and Testing; Specification M-202; S [M-202] 51—S [M-202] 64.

AAR Manual of Standards and Recommended Practices Casting Details; Truck Side Frames, Cast Steel—Design and Testing; Specification M-203; S [M-203] 65—S [M-203] 76.

AAR Manual of Standards and Recommended Practices Casting Details; Bolster Design Loads; Specification M-203A; S [M-203A] 77—S [M-203A] 82.

AAR Manual of Standards and Recommended Practices Trucks and Truck Details; Truck Performance for Rail Cars; Specification M-976; D [M-976] 31—D [M-976] 38.

"Ductile iron"; Wikipedia, the free encyclopedia; http://en.wikipedia.org/wiki/Ductile_iron#Composition; p. 1-3.

Hayrynen, Kathy L.; The Production of Austempered Ductile Iron (ADI); 2002 World Conference on ADI.

Aristizabal, Ricardo E.; "Intercritical Heat Treatments in Ductile Iron and Steel"; Materials Science and Engineering; Birmingham, Alabama; 2012.

FerroPem—Groupe—FerroAtlántica; Newsletter—Jan. 2012.

SAIFoundry; "Austempered ductile iron production properties"; http://www.slideshare.net/SAIFoundry/austempered-ductile-iron-production-properties-applications#;Mar. 19, 2012.

* cited by examiner

LIGHTWEIGHT FATIGUE RESISTANT RAILCAR TRUCK, SIDEFRAME AND BOLSTER

CROSS-REFERENCE TO RELATED APPLICATIONS

This is a continuation-in-part of U.S. application Ser. No. 13/678,087, filed on Nov. 15, 2012, the complete contents of which are herein incorporated by reference.

BACKGROUND OF THE INVENTION

1. Field of the Invention

This invention relates to an improved railcar truck and more particularly to a lightweight sideframe and bolster for a three piece freight car truck.

2. Brief Description of the Related Art

The more prevalent freight railcar construction in the United States includes what are known as three-piece trucks. Trucks are wheeled structures that ride on tracks and two such trucks are normally used beneath each railcar body, one truck at each end. The "three-piece" terminology refers to a truck which has two sideframes that are positioned parallel to the wheels and the rails, and to a single bolster which transversely spans the distance between the sideframes. The weight of the railcar is generally carried by a center plate connected at the midpoint of each of the bolsters.

Each cast steel sideframe is usually a single casting comprised of an elongated lower tension member interconnected to an elongated top compression member which has pedestal jaws on each end. The jaws are adapted to receive the wheel axles which extend transversely between the spaced sideframes. Usually, a pair of longitudinally spaced internal support columns vertically connects the top and bottom members together to form a bolster opening which receives the truck bolster. The bolster is typically constructed as single cast steel section and each end of the bolster extends into each of the sideframe bolster openings. Each end of the bolster is then supported by a spring group that rests on a horizontal extension plate projecting from the bottom tension member.

Railcar trucks must operate in severe environments where the static loading can be magnified, therefore, they must be structurally strong enough to support the car and the car payload, as well as the weight of its own structure. The trucks themselves are heavy structural components which contribute to a substantial part of the total tare weight placed upon the rails. Since the rails are typically regulated by the railroads, who are concerned with the reliability and the wear conditions of their tracks, the maximum quantity of product that a shipper may place within a railcar will be directly affected by the weight of the car body, including the trucks themselves. Hence, any weight reduction that may be made in the truck components will be available for increasing the carrying capacity of the car.

The designers of the early cast steel trucks experimented with several types of cross sections in their quest to reduce sideframe weight, but were unable to develop a successful "open" cross section. In fact, the efforts were so unsuccessful that, to this day, the Association of American Railroads (AAR) prohibits open section sideframes. Modern cast steel sideframes currently used in the three-piece truck configurations are designed with cross sections having either a box or C-shape. To produce these cross sections, numerous cores must be used in the molding process, but the use of cores increases production costs and complicates the pouring process by adding complex channels inside the mold which must be filled with molten metal.

Fabricated sideframes were later experimented with, and they were seen as a revolutionary lightweight replacement for the cast sideframe. However, the presence of welds in the fabricated sideframes were found to reduce fatigue life and hence, structural integrity of the sideframe, as compared to the cast structures. As a result of the low service life for fabricated sideframes, interest in the cast steel sideframes continued, but in order to improve the fatigue life, it became necessary to increase the structural cross-sectional thicknesses, which is a negative focus for obvious reasons.

Another problem hindering the development of lighter, yet stronger sideframes was the fact that structural development of a cast steel sideframe design is extremely expensive and prior to the modern computer, the load paths on a sideframe could only be evaluated after producing an expensive pattern and then pouring a test sample piece. Typically, the manufacturing process required several samples to be cast in order to produce a single part acceptable for testing. Furthermore, the loading tests which predict sideframe structural integrity are expensive and only a few machines exist which are officially approved by the AAR for verification purposes; one of those being at the ASF lab in Granite City, Ill. Nevertheless, even after all of the developmental stages have been completed, the AAR must still approve the design change. This process can take months, even years, for a complex design change. Therefore, it is not surprising that innovation in the railroad industry has proceeded slowly in the freight car truck design area. In spite of these handicaps, new analytical tools and a genuine need to help the railroads reduce costs is now at hand.

However, with the great strides made in development of computer technology, advanced engineering analysis has allowed designers to challenge these principles and to design car members which are actually stronger, yet lighter, than past designs. These latest techniques have increased the focus of attention towards maximizing the carrying capacity of the car while reducing the energy consumption realized from weight reductions in the railcar components.

SUMMARY OF THE INVENTION

Accordingly, it is an object of the present invention to reduce the weight of a railcar truck sideframe and bolster casting by efficiently utilizing the material such that an increase in the strength to weight ratio can be realized.

It is another object of the present invention to reduce the weight of the sideframes and bolster while reducing the stress concentrations at the critical areas of the railcar truck sideframe. According to preferred embodiments, the present invention accomplishes this by providing a sideframe and bolster of a railway car truck that are constructed such that basic overall sideframe and bolster appearance is maintained, but with the actual material from which the sideframe and bolster are constructed being a stronger material. In the present invention, according to a preferred embodiment, the sideframe and bolster are constructed from an austempered metal, and more preferably from austempered ductile iron. Alternately, the sideframe and bolster according to the present invention may be constructed from other austempered metals, such as, for example, austempered steel. According to the other embodiments, the sideframe and bolster may be constructed from austempered metal alloys.

Embodiments of the invention provide an improved sideframe and bolster that are lighter in weight and stronger than or as strong as prior sideframes and bolsters. According to a preferred embodiment a preferred reduction in weight from the prior steel bolster and sideframe may involve a reduction in weight by about up to 8%. Cast iron has a density, 0.26 lbs/in^3, which is approximately 8% less than steel, 0.283 lbs/in^3. The improved sideframe and bolster, according to preferred embodiments, which are constructed from an austempered ductile iron, allows for these components to be constructed to be lighter in weight.

According to some embodiments of the invention, where austempered ductile iron is used to construct the sideframe and/or bolster, another benefit of the present invention is that iron is easier to pour than steel and actually increases in volume, slightly, as the ductile iron cools, compared to steel which shrinks. This difference results in a more efficient use of the materials, meaning less metal is used to make the same final shape, as a way of reducing the sideframe and bolster weight. Both features combined allow for a lighter weight railway car truck, sideframe and bolster, while utilizing the standard designs.

According to a preferred embodiment, an improved sideframe and bolster are provided which are constructed from a material that has sufficient strength to support locomotive railroad cars, such as, for example, in a preferred truck arrangement where a pair of wheel axles are transversely disposed and received in the pedestal jaws of the sideframe.

It is an object of the present invention to accomplish the above objects by providing a bolster and side frame that is constructed from austempered metal, and, preferably, from austempered ductile iron (ADI) or austempered steel. According to a preferred embodiment, the austempered ductile iron is produced by a suitable austempering process. For example, austempering of ductile iron may be accomplished by heat-treating cast ductile iron to which specific amounts of nickel, molybdenum, or copper or combination thereof have been added to improve hardenability; the quantities of the elements needed to produce the ADI from ductile iron are related to the thickest cross section of the bolster or sideframe; the thicker the cross section the more alloy is needed to completely harden the metal. Austempered steel and other austempered metals and austempered metal alloys, may be produced by any suitable austempering processes. Austempered steel is produced by a suitable austempering process. For example, austempering of steel may be accomplished by heat-treating cast steel to which specific amounts of chromium, magnesium, manganese, nickel, molybdenum, or copper or combinations thereof have been added to improve hardenability; the quantities of the elements needed to produce the austempered steel from the cast alloy steel are related to the sideframe and bolster configurations and, for example, depend on the thickest cross sectional area of the respective sideframe or bolster.

Another object of the invention is to provide improved sideframes and bolsters that are constructed from a material that has a specific gravity that is less than that of alloy steel, but yet provides suitable strength.

Another object of the invention is to provide a sideframe and bolster that are constructed from a material that has a specific gravity of about 0.26 lbs/in3.

According to preferred embodiments, an improved bolster and sideframe are provided that may be lighter in weight than prior sideframes and bolsters, but possess suitable strength that is greater than or equal to prior sideframes and bolsters having the same or greater weights, while at the same time, having improved handling and capabilities for transferring stress loads.

According to preferred embodiments, a railcar truck is provided constructed from a pair of sideframes and a bolster. The improved truck is designed to be lighter in weight than prior trucks, while also possessing suitable strength that is greater than or equal to prior trucks. According to some preferred embodiments, the truck is constructed to have improved strength to weight ratios and/or improved payload-to-weight ratios.

The sideframes and bolsters may be made from castings.

The present invention also may be constructed, according to an alternate embodiment, to provide inspectional capabilities by providing one or more openings, or providing sections of connecting walls or wall portions between the sideframe sidewalls. The reduced weight improved sideframes and bolsters may also provide economical advantages which have large effects on production costs, finishing costs, shipping costs and in-service operational costs. The improved sideframes and bolsters also may facilitate repair and replacement of a railroad car, since, when a part breaks in the field, often the spare part has to be carried to the replacement location. Typically, a broken sideframe or bolster requires lifting the railcar off the damaged truck. Additional equipment must therefore be brought in at the site of the vehicle to remove and replace the damaged component. Often, the use of forklifts and other lifting equipment is needed to move the sideframe or bolster. The site of the car in need of a repair may be difficult to access, and, in some instances, the repair or replacement may possibly take place in bad terrain and unfavorable climate conditions. The reduced weight of the truck and components thereof provides for less of a load to be transported to the field location for service.

The present invention also improves efficiencies. Since railway cars are only rated for a specific amount of total weight, including all the components and the cargo, if the car is a car that carries a commodity, coal, sand, rock, etc., the lighter the weight of the car the more commodity it can carry. That means every trip it will get extra payoff, which may be significant over the life of a moving car. In some instances, because railway cars are only rated for a specific amount of total weight, including all the components and the cargo, if those cars are carrying larger objects, like cars, then in some instances, it may be possible to be able to carry an extra car (or other large item), owing to the weight reduction of the truck set, which could be a few hundred pounds. However, even if the load capacity is not reached, the present truck set (sideframes and bolster) enables each car to be up to a few hundred pounds lighter, which requires less fuel to move it, and thereby conserves resources. This is the case whether the train is loaded or unloaded.

According to alternate embodiments, the sideframe and bolster may be cored to remove certain sections, and ribs may be added for strengthening. The lighter weight of the material, the austempered metal, and, in some embodiments, the addition of coring and/or ribs, provides a lighter truck, and truck components, such as, sideframes and bolsters, that can provide increased operating efficiencies and load handling efficiencies. The coring and ribs may be formed through the casting and/or molding process, or may be formed through reaming and/or welding.

According to some preferred embodiments, the utilization of an austempered metal, such as austempered ductile iron, permits the sideframe to be constructed to be lighter in weight, yet preserve the benefits of the open sideframe construction. According to these preferred embodiments, austempered ductile iron may be used.

Some preferred embodiments of a truck include a pair of sideframes constructed in accordance with of one of the preferred embodiments, and a bolster, constructed in accordance with one of the preferred embodiments, where the bolster spans between the sideframe pair to form a truck.

In addition to the economic production savings, by constructing the sideframes and bolsters from the preferred austempered metal, further economic benefits may be realized in saving of shipping costs because the sideframe may be constructed to weigh significantly less. For example, even where a steel truck set weight was able to be reduced about 200-250 pounds, with the utilization of structural ribs and/or coring designs, the truck set according to the present invention, may still be constructed to be about 8%, approx. 300 lbs, lighter in weight than prior truck sets. An advantage is that more finished truck sets can be shipped per load, thereby reducing shipping costs. In addition, railroads can also save operating costs per mile by being able to convert the weight savings gained by a lighter truck assembly into a corresponding gain in additional payload carried. This also equates to fuel savings if the weight reduction is not offset by increased payload weight.

Briefly stated, the present invention primarily involves reduction of weight of the sideframe and bolster, without sacrificing the strength and durability of the finished product, including a truck set constructed from these components.

BRIEF DESCRIPTION OF THE DRAWINGS

Other objects and advantages of the present invention will become apparent from the following detailed descriptions taken in conjunction with the drawings wherein.

DESCRIPTION OF THE PREFERRED EMBODIMENTS

Preferred embodiments of the invention include railcar sideframes, bolsters and truck sets that are constructed to have improved properties, and, preferably, improved strength to weight ratios. The improved trucks constructed using the improved sideframes and bolsters, preferably have payload-to-weight ratios that are greater than prior trucks. Preferred embodiments of the trucks constructed using the sideframes and bolsters are produced from an austempered metal, such as, for example, austempered ductile iron.

Figure 1:
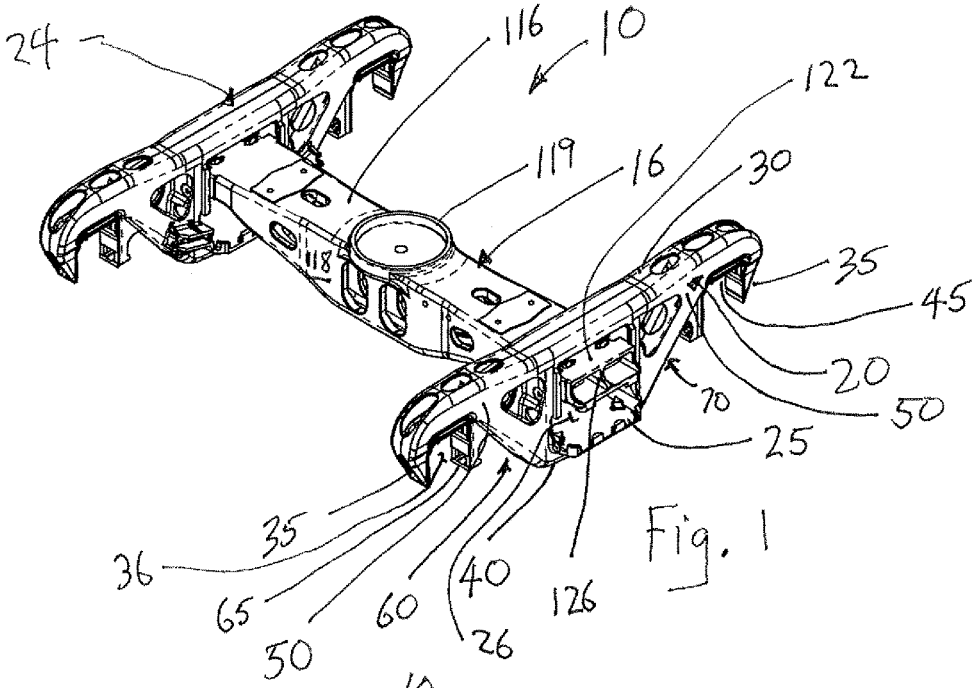
FIG. 1 is a perspective view of a railway truck with a pair of sideframes and a bolster according to the present invention, shown without the wheelset.
Figure 2:
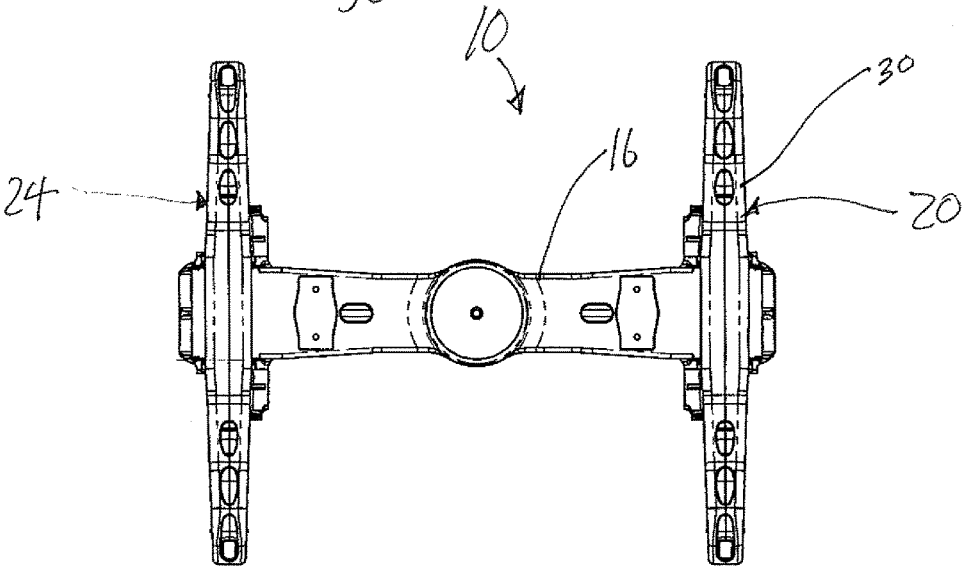
FIG. 2 is a top plan view of the truck of FIG. 1.
Figure 3:
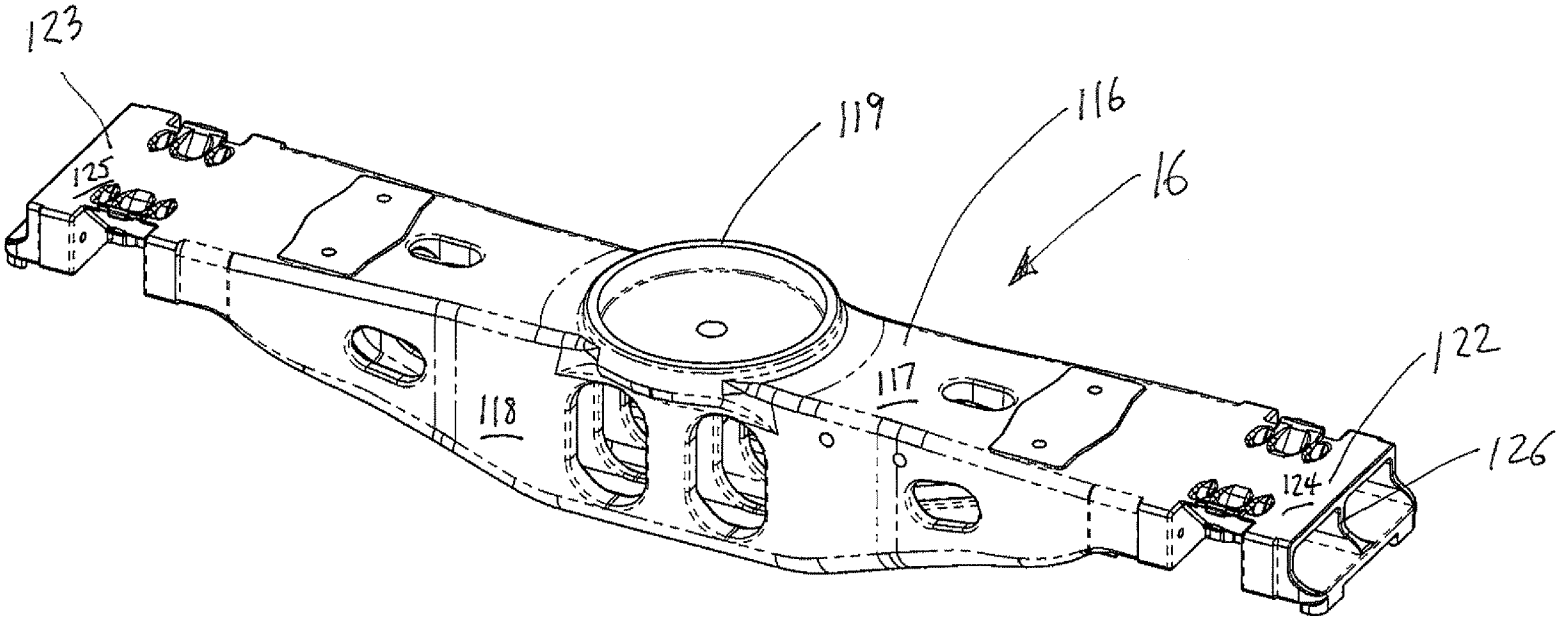
FIG. 3 is a perspective view of the bolster of FIG. 1, according to the present invention, shown separately from the sideframe.

A preferred embodiment of a sideframe and bolster arranged in a configuration with a pair of sideframes 20, 24 and a bolster 16 forming a railcar truck 10, is illustrated in FIGS. 1-3. The sideframe 20, 24, bolster 16 and truck 10 embodiments illustrated in FIGS. 1-3 are exemplary embodiments, and, according to the present invention, alternate embodiments, including sideframes and bolsters, having different configurations may be constructed in accordance with the present invention. According to some preferred embodiments, the prior art geometry is maintained, and the components of the truck, such as, for example, the sideframes and bolsters are constructed from austempered metal.

Referring now to FIG. 1, there is shown a railway vehicle truck 10 common to the railroad industry. Truck 10 comprises generally a pair of longitudinally spaced wheel sets (not shown), each set including an axle with laterally spaced wheels attached at each end of the axles in the standard manner. A pair of transversely spaced sideframes 20,24 is mounted on the wheel sets. The sideframes 20, 24, according to preferred embodiments, preferably are constructed from a material, such as metal, that has a specific gravity that is lower than that of steel, but provides suitable strength for the sideframes 20, 24, and preferably strength that is equal to or greater than steel. According to preferred embodiments, the sideframes 20, 24 are constructed from an austempered metal, and more preferably from austempered steel or austempered ductile iron. Alternately, the sideframes 20, 24 may be constructed from other austempered metals. According to a preferred embodiment, the sideframes 20,24 may be reduced in weight by about up to 8%, approximately 80 lbs each, when the austempered metal is austempered ductile iron, as cast iron has a density, 0.26 lbs/in^3, which is approximately 8% less than steel, 0.283 lbs/in^3. Embodiments of the present invention sideframes and bolsters, such as, for example, the sideframes 20,24, and bolster 16 may be constructed using austempered ductile iron. The sideframes 20,24 of the present invention preferably are lighter than prior sideframes of equal sizes and dimensions, yet possess similar or greater strength. Alternately, the sideframes 20,24 of the present invention may be constructed from an austempered metal, which may include austempered metals, austempered metal alloys, and, more preferably, may include austempered metals and austempered metal alloys having a specific gravity of about 0.26 lbs/in3. Austempered ductile iron is one preferred austempered metal. Additionally, the bolster 16, shown and described herein, may be constructed from the same materials as the sideframes 20,24, preferably austempered metal.

According to preferred embodiments of the invention, exemplary embodiments of sideframes 20, 24 and bolster 16 are illustrated in FIGS. 1-4. In FIG. 1, the sideframes 20,24 are arranged with the bolster 16 to form a railcar truck 10 (the wheel sets not being shown). Sideframes 20,24 each include a bolster opening 26, respectively, in which there are supported by means of spring sets (not shown), a bolster 16. Bolster 16 extends laterally between each sideframe 20,24 and generally carries the weight of the railcar. Upon movement in the vertical direction, bolster 16 is sprung by spring sets (not shown) which are attached to a spring seat plate 25 at the bottom of sideframes 20,24. The bolster 16 preferably is of a standard configuration, with a geometry known in the art, but is constructed to be lighter in weight. According to preferred embodiments, the bolster 16 preferably is constructed from a material, such as an austempered metal having a specific gravity that is lower than that of steel, but which is equal to or greater than steel in strength. The bolster 16 may be composed from the materials described herein in connection with the sideframes 20,24. For example, according to a preferred embodiment, the bolster 16 may be reduced in weight by about up to 8%, approximately 140 lbs, when the austempered metal is austempered ductile iron, as cast iron has a density, 0.26 lbs/in^3, which is approximately 8% less than steel, 0.283 lbs/in^3. According to preferred embodiments, the sideframes 20,24 and bolster 16 may be constructed by any suitable casting process. The process for producing the sideframes and bolsters, such as, for example, the sideframes 20,24 and bolster 16, according to a preferred embodiment, involves producing austempered ductile iron by a suitable austempering process. For example, one process involves austempering of ductile iron by heat-treating cast ductile iron to which specific amounts of nickel, molybdenum, manganese or copper, or combination thereof have been added to improve hardenability.

As previously mentioned, historical design considerations for addressing the sideframe compressive and tensile stress problems have largely involved increasing the cross-sectional thicknesses of the top and bottom members without regard to weight. According to the exemplary embodiment, a sideframe 20 is illustrated, and is constructed to be functionally stronger, yet use less metallic mass. The present invention is designed to improve upon prior sideframes, which, according to one preferred embodiment, provides an open, yet solid sideframe 20,24, that has an increased payload-to-weight ratio. Preferred embodiments provide a sideframe configuration that is constructed from an austempered metal, such as, for example, austempered ductile iron.

According to preferred embodiments having the structure of the sideframe constructed as an open, yet solid, sideframe, a typical payload-to-weight ratio may be exceeded with the use of the preferred austempered metal sideframe composition.

Figure 4:
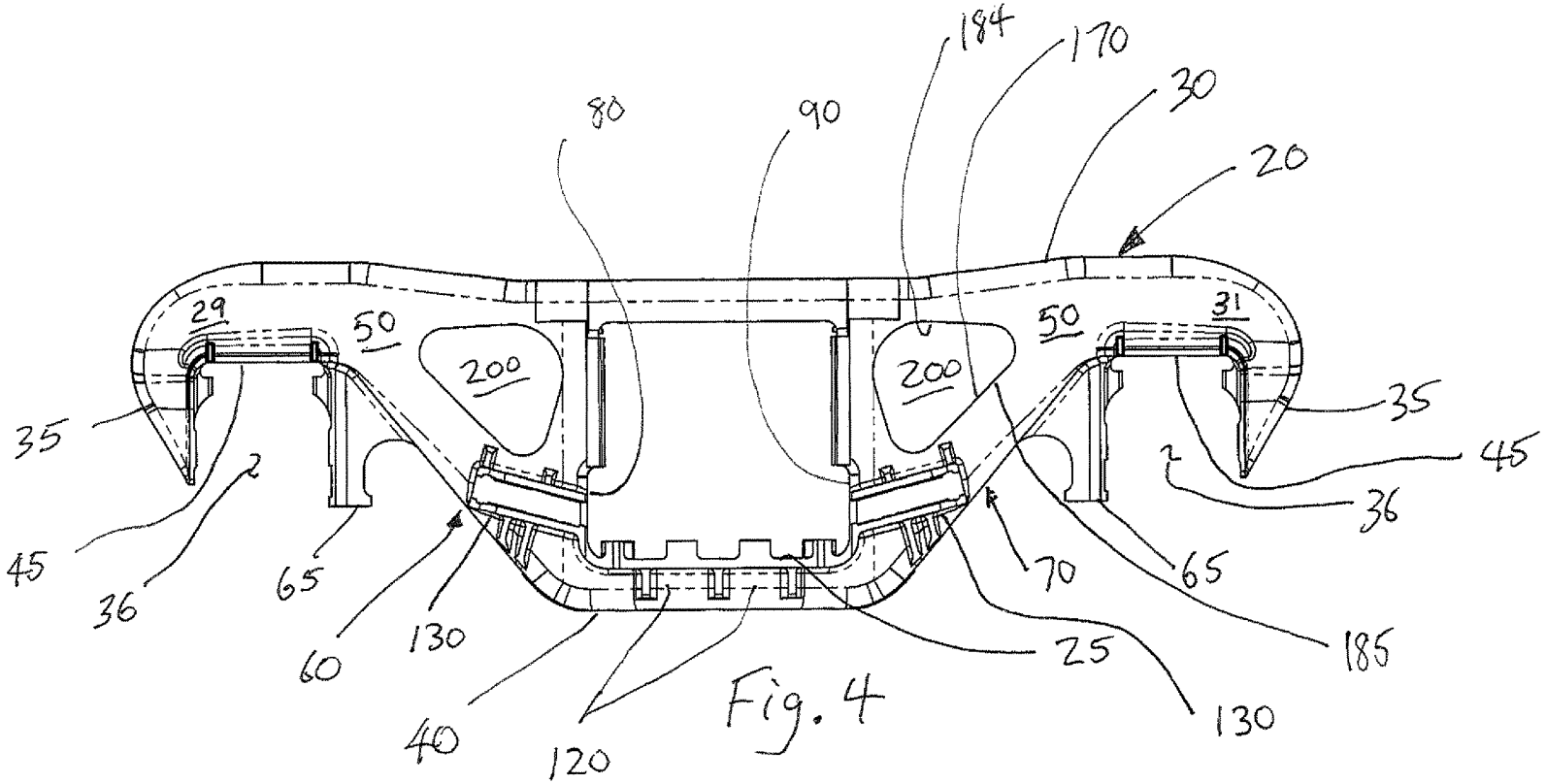
FIG. 4 is a front elevation view of the truck sideframe of FIG. 1, according to the present invention, shown separately from the bolster.

Since the sideframes 20,24 are identical members, only one of them will be described in greater detail. Referring now to FIGS. 1-2 and 4, a sideframe 20 incorporating the features of the present invention is shown and generally comprises an upper compression member flange 30, extending lengthwise of truck 10 and a lower tension member flange 40, also extending the length of truck 10. The compression member flange 30 and the lower tension member flange 40 may be solid members. Vertical web 50 extends between the upper flange 30 and the lower flange 40 and connects the upper and lower flanges together, thereby defining the overall structural shape of sideframe 20. According to one embodiment, a web may be provided on the opposite side (not shown), and the sideframe or portions thereof between the front web 50 upper flange 30 and lower flange 40, may be hollow, or may be partially hollow. Reviewing FIG. 4 in more detail, it is seen that lower tension member flange 40 has a midsection which is generally parallel to upper compression member 30, and it also has a front and rear section which is comprised of upwardly extending solid diagonal flange sections 60,70 for integrally connecting the lower flange 40 to the upper flange 30 at each sideframe end 29,31. Even though the sideframe flanges are constructed as one continuous flange member, the upper flange experiences compression loading during operation, while the lower flange experiences tensile loading. As shown in FIG. 4, according to one embodiment, vertical columns 80,90 may be provided to connect the upper and lower members together in order to add structural support and integrity to sideframe 20; the columns also may define the bolster opening 26. According to the embodiment illustrated in FIG. 4, one embodiment may include a construction where neither of the vertical columns 80,90 fully extends between the top and bottom members, although they still define the bolster opening. According to that alternate embodiment, columns 80 and 90 may extend vertically downward from top flange member 30, to spring seat plate 25, thereby forming a center U-shaped structure. According to preferred embodiments, springs (not shown) are seated on the spring seat plate 25 when the sideframe 20 is assembled with another sideframe 24 and bolster 16 to form a truck 10.

According to one embodiment, the columns 80,90 may be integrally connected to upper flange member 30, and the spring seat plate 25 is suspended similar to a simply supported beam having an intermediate load and, according to one embodiment, optionally, in order to provide stability and strength to the columns 80,90 and/or the spring seat plate 25, lower support struts 120 may be provided that tie the plate 25 to vertical web 50 and lower flange 40. According to one embodiment, column reinforcing ribs 85,95 may be provided and added to columns 80,90 in order to tie the columns to vertical web 50.

FIG. 4 also shows that each end 29 and 31 of sideframe 20 also includes a downwardly projecting pedestal jaw 35, respectively depending from each end. According to a preferred embodiment, it is at the pedestal jaw area where the flange of the top compression member 30 and the flange of the lower tension member 40 are ultimately connected together structurally. In the exemplary embodiment illustrated, structurally completing the jaw area is the L-shaped bracket member 65 depending downwardly from the pedestal jaw 35. The addition of each of the brackets thereby defines the axle-accommodating pedestal jaw opening 36 in which the axles 18 of the railcar ride. According to an alternate embodiment (not shown), optionally, the pedestal jaw roof 45 may be provided with pedestal jaw reinforcing gussets for connecting and supporting the jaw roof 45 to the vertical web 50. Shown in FIG. 4 are the brake beam guides 130. According to preferred embodiments, these guides 130 are only found on the inboard side of sideframe 20 and they retain the brake beams used to apply force to wheel sets when stopping the railcar. The guides 130 are shown having a slight downwardly angled horizontal pitch and they connect to the lower tension member diagonal flanges 60,70 on one end and to the vertical columns 80,90 on the other end. The inboard side of guide 130 is also connected to web 50, thereby adding structural support to the sideframe midsection.

As mentioned, the top flange member 30 is known to undergo compression when the railcar truck is loaded while the bottom flange 40 undergoes a tensile loading. Moreover, it is well known that the very distal ends 29,31 of sideframe 20, namely at the pedestal jaws 35, are the least stressed areas of the sideframe and the forces acting on this area are mainly straight down, static loads, although there is some twisting or dynamic loading, but its occurrence is infrequent and is usually present only when the truck becomes out of square, as in turning. Furthermore, it is also well known that the center or midsection of the sideframe experiences the greatest magnitude of forces due to the loads transferred from the bolster 16 into the spring set groups. Since each end 29,31 of sideframe 20 is supported by the axles (not shown) and wheel sets (not shown), the midsection is effectively suspended between the two ends, making the static and dynamic loading, as well as twisting and bending moments, the greatest in the midsection area of the sideframe. The sideframe midsection therefore has to be structurally stronger than the distal ends 29,31, and the present sideframe has been specifically designed with that in mind.

The sideframes 20,24 and bolster 16 may be constructed with a suitable thickness that will support the loads to be handled thereby. For example, the thickness of the flanges 30, 40 and web 50 may be sized so that the components, including when assembled together to form a truck, will have a desired load supporting strength.

According to some embodiments, sideframes may be constructed with structural components that have hollow interiors. Although the exemplary sideframe 20 is shown having a solid vertical web 50, other sideframes, constructed in accordance with the present invention may be cast with structural components that have hollow interiors. Referring again to FIG. 4, it is seen that vertical web 50 contains a pair of lightener openings 200 on each end of the sideframe for further reducing the weight of the sideframe 20. Because it is well known that openings act as stress accumulation points, according to some embodiments, the web 50 may be provided with a lip (not shown) around the entire peripheral edge of lightener opening 200 for maintaining a relatively high section modules around the opening. Therefore, according to some sideframe embodiments shown in FIGS. 1-2, and 4, a lip, when provided, adds structural strength around lightener opening 200 and to sideframe 20, thereby increasing resistance to fatigue cracking from cyclic flexure stressing. According to one alternate embodiment, as a means for maximizing the section modules while minimizing the metallic mass being added, the lip may be configured so that it does not remain at a constant cross-sectional thickness around peripheral edge.

According to a preferred embodiment, these minute details concerning metallic mass versus localized loading stresses have been carried out all throughout the exemplary sideframe design. For example, it is known that the greatest stresses occur at the midsection and become proportionately smaller along the distance to the pedestal jaw; therefore, according to some embodiments, the entire structure may be configured so that it is not as structurally large at ends 29,31 as it is in the midsection. According to some embodiments, the top and bottom flanges 30,40 may be designed to neck down or taper, starting from the point near the midsection and the vertical columns 80,90, outward towards the pedestal jaws in a quite extreme fashion in order to save weight. The top and bottom members 30,40 may decrease in width. For example, according to some embodiments, the sideframe may be constructed with a midsection width that is slightly larger with the distal ends 29,31 having a substantially smaller width, making each of the top and bottom flanges even lighter than traditional shaped sideframes.

According to preferred embodiments, the midsection of the upper compression member area which is between the vertical columns 80 and 90 may also be configured for weight reduction. According to some alternate sideframe embodiments, lower tension members may be provided having structural cross-sectional profiles which are closed, box-like, hollow frames and the entire upper compression members may have similar structural profiles. According to a preferred embodiment, the sideframe 20 illustrated in FIGS. 1-2, and 4, may be constructed having a lower midsection that is structurally reinforced through the addition of lower support struts 120, and, in addition, the structural profile of the upper midsection between the vertical columns also may be reinforced.

Referring to FIG. 3, a bolster 16 is illustrated, which, preferably, is constructed from an austempered metal, as discussed herein, and more preferably, austempered ductile iron. The bolster 16 has a box-like body 116 with top wall 117, and interconnecting side walls 118. Though not shown, the bolster 16 may also have a bottom wall or wall portions spanning between the side walls 118, which preferably may be disposed opposite the top wall 117. A pin receptor 119 is centrally located in top wall 117 and two distal ends 122,123 extend outwardly of the body 116 at a distance from receptor 119 beyond the side frames 20,24 (see FIG. 1) Each distal end 122,123 includes flat, horizontal, surfaces 124, 125 adapted to directly carry a rail car body (not shown) at or adjacent the side sills thereof. According to some embodiments, the bolster 16 may also include an interior web 126 parallel to and central of the side walls 118.

In an alternate configuration, not shown, the surfaces 124,125 of distal ends 122,123 may be provided with seats to receive friction side bearings generally to permit controlled sliding movement between the bolster ends and the railcar body. One alternate embodiment, not shown, involves providing seats at the distal ends 122,123 that have a depression or concave spherical segment surfaces so as to receive convex concentric undersurfaces of bearings.

According to preferred embodiments, the ends of the bolster 16 preferably incline inwardly from top to bottom (so as to be in keeping within the American Association of Railroads standard clearance line at track side).

According to preferred embodiments, sideframes and bolsters are constructed from austempered ductile iron, and according to a preferred embodiment, they are formed from austempered ductile iron having a minimum tensile strength of 130 ksi, a minimum yield strength of 90 ksi, and a minimum elongation in 2 inches of 2%. Additionally, some preferred embodiments have a BHN (Brinell hardness number) within a range of about 302 to about 460. According to some more preferred embodiments, sideframes and bolsters are formed from austempered ductile iron having a minimum tensile strength of 190 ksi, a minimum yield strength of 160 ksi, and a minimum elongation in 2 inches of 7%. The sideframes and bolsters also may have a BHN within a range of about 302 to about 460. According to a preferred embodiment, the ADI is a 190/160/7 in a standard 1" Y-block. In accordance with preferred embodiments, the ADI formed sideframes and bolsters have carbon equivalency (CE) range of from about 4.3 to about 4.73, and more preferably, has a CE range of from about 4.3 to 4.6. Since alloying elements other than carbon are used in the preferred embodiments, the carbon equivalency provides a value taking into account a conversion of the percentage of alloying elements other than carbon to the equivalent carbon percentage. Iron-carbon phases are better understood than other iron-alloy phases, so the carbon equivalency (CE) is used. A convenient method to accomplish this is to combine the elements of the chemical composition into a single number, equaling the carbon equivalent. There are a number of formulas for ascertaining carbon equivalency. Generally, three primary carbon equivalent formulae have been commonly used in prediction algorithms for hydrogen-assisted cracking of steels. These include: Pcm, CEIIW and CEN. According to preferred embodiments, preferred CE values for ADI used to construct the sideframes and bolsters is determined by: CE=% C+⅓ (% Si). According to preferred embodiments, the iron is alloyed with additional components, including those set forth in the formulas below. Preferred embodiments of the sideframes and bolsters are constructed from ADI that has an alloy content that is greater than 4.0%. Further preferred embodiments of the sideframes and bolsters are constructed from ADI having alloy content greater than 4.0% and a carbon equivalency value of 4.37 to 4.73.

According to some preferred embodiments, ADI sideframes and bolsters are made in accordance with the following composition:

| | |
|---|---|
| Carbon Equivalent | 4.37-4.73 |
| Carbon | 3.60-3.80% |
| Silicon | <2.60%; |
| Copper | 0.50-0.70% |
| Manganese | 0.35-0.45% |
| Nickel | <0.03% |

-continued

| | |
|---|---|
| Chromium | <0.05% |
| Magnesium | 0.030-0.050% |
| Iron | balance of the composition. |

In one proposed example, the above composition is cast in a mold to form a sideframe and in another mold to form a bolster. Cores, such as sand cores, may be used to define cavities that will be formed in the completed respective sideframe or bolster. The molten metal may be introduced into the mold cavity or cavities through one or more gates. When the molten metal has filled the mold cavities, and it is allowed to solidify. The sideframe or bolster casting is removed from the mold, and cores are removed from the respective casting, or broken apart if required for their removal. The sideframe and bolster castings are austempered through a series of heating and cooling steps. The cast iron is raised to a heating temperature above the $Ae_3$ temperature, or above 910 degrees C. (*Modern Physical Metallurgy*, R. E. Smallman, A. H. W. Ngan, Chapter 12, Steel Transformations, p. 474, FIG. 12.1) After heating to above about 910 degrees C., the respective sideframe or bolster casting is then rapidly quenched and held at the lower temperature. According to this proposed example, the resultant sideframe and bolster formed from the composition and ADI, is a 190/160/7 ADI.

According to preferred embodiments, the walls have carbon equivalent (CE) in a prescribed range. One way in which the carbon equivalent (CE) value is expressed, is CE=% C+⅓ (% Si). According to preferred embodiments, the CE range is about 4.3 to about 4.6. According to preferred embodiments, where the wall thickness is between about 0.25" to 2", the sideframe or bolster wall has a CE range of from about 4.3 to about 4.6, and where the wall is over 2", then the CE range is between about 4.3 to 4.5. In addition, preferred embodiments of the ADI sideframe and bolster are constructed from casting that has minimum nodularity properties. According to preferred embodiments, the ADI sideframe and bolster castings have a minimum nodule count of 100/mm2 and minimum nodularity of 90%.

According to another preferred formulation, the ADI casting is made from a composition as follows:

| Elements | Percentage | Preferred Control Range |
|---|---|---|
| C Carbon | 3.6% | +/− 0.20% |
| Si Silicon | 2.5% | +/− 0.20% |
| Mg Magnesium | (% S × 0.76) + 0.025% | +/− 0.005% |
| Mn Manganese | | |
| Max. section > 1/2" | 0.35% maximum | +/− 0.05% |
| Max. section < 1/2" | 0.60% maximum | +/− 0.05% |
| Cu Cooper | 0.80% maximum (only as needed) | +/− 0.05% |
| Ni Nickel | 2.00% max. (only as needed) | +/− 0.10% |
| Mo Molybdenum | 0.30% max. (only as needed) | +/− 0.03% |
| Sn Tin | 0.02% max. (only as needed) | +/− 0.003% |
| Sb Antimony | 0.002% max. (only as needed) | +/− 0.0003% |
| P Phosphorus | 0.02% maximum | |
| S Sulfur | 0.02% maximum | |
| 0 Oxygen | 50 ppm maximum | |
| Cr Chromium | 0.10% maximum | |
| Ti Titanium | 0.040% maximum | |
| V Vanadium | 0.10% maximum | |
| Al Aluminum | 0.050% maximum | |
| As Arsenic | 0.020% maximum | |
| Bi Bismuth | 0.002% maximum | |
| B Boron | 0.0004% maximum | |
| Cd Cadmium | 0.005% maximum | |

-continued

| Elements | Percentage | Preferred Control Range |
|---|---|---|
| Pb Lead | 0.002% maximum | |
| Se Selenium | 0.030% maximum | |
| Te Tellurium | 0.003% maximum | |
| Iron | Balance of formula | |

Iron being the balance of the composition, which may range from about 89 to about 95%.

According to preferred embodiments, the sideframes and bolsters include at least some walls whose thicknesses are greater than ¾". Some preferred embodiments are constructed from ADI of the above formulas, wherein hardening alloys are added to the ductile iron forming the casting so as to reduce pearlite formation during the austempering quenching step. Preferred hardening alloys include alloying elements, such as Mo, Cu and Ni. The hardening alloys may be added, preferably, in amounts less than or up to the maximum respective amount. For example, in the first listed formula set forth above, the hardening alloys may be added to the formula up to the maximum amounts specified in the second listed formula (above).

According to preferred embodiments, the ADI sideframes and bolsters may be formed with an ADI alloy that contains nodulizing elements. One example of a preferred embodiment, includes Mg as a nodulizing element. In addition, according to alternate embodiments, other examples of nodulizing elements, include beryllium, calcium, strontium, barium, yttrium, lanthanum and cerium. Although Mg is used in preferred embodiments, in other embodiments an alternative nodulizing element or combination of elements may be used. According to preferred embodiments, the amount of residual Mg plus the amounts of other nodulizing elements (e.g., beryllium, calcium, strontium, barium, yttrium, lanthanum and cerium) is less than or up to about 0.06%. According to some preferred embodiments, Ce may be used as an alloy to facilitate nodulization. According to some preferred embodiments, the ADI sideframes and bolsters are produced by forming a ductile iron casting, and subjecting the casting to an austempering process of elevated temperatures and quenching. The ADI sideframe and bolsters according to the invention are produced to have high nodularity and nodule formation throughout the solidification of the ADI bolster and sideframe ADI castings, which is preferably done using an inoculant. According to preferred embodiments, a mixture of La, Ca, S and O is provided in the inoculant. The inoculant may be referred to as a post inoculant, as the ductile iron may be alloyed with one or more alloy elements, and, the inoculant may be a separate addition, added to the molten ductile iron/alloy or mold to which the molten ductile iron/alloy is being added. The sideframe and bolster of the invention preferably are produced using ductile iron, to which small amounts of other elements have been added, as discussed herein, and to include in the addition thereto, preferably, at the molten stage of the ductile iron/alloy, an inoculant. The inoculant preferably is an element or combinations of elements that increase nodule formation. According to a preferred embodiment, the inoculant is selected from the group consisting of La, Ca, S and O (and mixture thereof). The inoculant may be added to the stream of molten metal (the molten ductile iron and alloy components) as it is poured into the mold. Alternatively, the inoculant is added to ductile iron by adding the inoculant in the mold. Preferred embodiments of the ADI bolsters and sideframes are produced from inoculated ductile iron (by an addition of the inoculant to the molten material as it is being admitted to the mold, or introducing the inoculant to the mold into which the molten ductile iron is to be admitted). The inoculated ductile iron casting is then austempered. The increased nodule formation and high nodularity throughout the improved sideframes and bolsters provides improvements in strength, particularly an increase resistance to fatigue and cracking.

According to embodiments, the sideframes and bolsters are constructed having a high nodule count, high nodularity, or both. According to some preferred embodiments, the nodularity and nodule count may be optimized. Sideframes and bolsters according to preferred embodiments are constructed having a minimum nodule count, which may be expressed in a number of nodules per unit of area. For example, according to some preferred embodiments, the ADI sideframes and bolsters are constructed having a nodule count that is at least 90 per mm2, and preferably, at least 100 per mm2. Some preferred embodiments of the ADI sideframes and bolsters are provided having nodularity that is a minimum of 80%, and more preferably, at least 90%. According to some preferred embodiments, bolsters and sideframes are constructed from ADI and have, both a nodule count that is at least 90 per mm2, and preferably, at least 100 per mm2, and also have nodularity that is a minimum of 80%, and more preferably, at least 90%.

According to preferred embodiments, the wall thicknesses of the sideframe, bolster and truck assembly including them may be constructed to be lighter, yet at the same time, impart suitable strength characteristics. The invention further provides embodiments of bolsters, sideframes and trucks with improved constructions having walls that have thicknesses that allow for improved configurations.

The sideframe 20,24 are constructed being formed from walls. According to some preferred embodiments, the upper flange 30 and lower flange 40 are formed by walls. The walls generally have a thickness, and may define a space therebetween, with one side of the wall forming the flange being an exterior wall. The web 50 has a thickness and may be comprised of a wall having the same or different thickness as one of the upper or lower flanges 30,40, or both. According to some embodiments, the wall thickness of the flanges 30,40 and web 50 may be the same, and according to other embodiments, one or more of the walls defining the flanges 30,40 or web may be different. The spring seat 25 also may be constructed from a wall having a preferred thickness. According to some embodiments, the wall thicknesses of walls forming the side frame may be the same, and in other embodiments, the wall thicknesses of the walls forming the sideframe may be different.

Preferred embodiments of a sideframe 20,24 are constructed from austempered ductile iron, and have a preferred wall thickness of from about 0.25"-2.5", and more preferably, from about 0.375" to about 1.75". The wall thicknesses are for the sideframe walls, and may include one or more of the walls forming the flanges 30,40, webs 50, spring seat 25, and jaw roof 45. According to some preferred embodiments, the sideframe 20,24 is constructed so that at least one wall has a maximum thickness of about 0.375". According to another preferred embodiment, the sideframe 20,24 is constructed so that at least one wall has a maximum thickness of about 0.25". According to some preferred embodiments, the sideframe 20,24 is constructed so that the walls have a maximum thickness of about 2.5". According to another preferred embodiment, the sideframe 20,24 is constructed so that the walls have a maximum thickness of about 1.75". Other preferred embodiments include sideframe embodiments where at least one wall has a maximum thickness of 0.25" and the remaining walls are within a thickness range where the maximum wall thickness for any walls is 2.5". Still other preferred embodiments include sideframe embodiments where at least one wall has a maximum thickness of 0.25" and the remaining walls are within a thickness range where the maximum wall thickness for any walls is 1.75". According to yet other preferred embodiments, the sideframe 20,24 has at least one wall with a maximum thickness of 0.375" and the remaining walls are within a thickness range where the maximum wall thickness for any walls is 2.5". Still other preferred embodiments include sideframe embodiments where at least one wall has a maximum thickness of 0.375" and the remaining walls are within a thickness range where the maximum wall thickness for any walls is 1.75".

The bolster 16 is shown having a plurality of walls, including a top wall 117, interconnecting side walls 118, and a wall or web 126. Preferred embodiments of a bolster 16 are constructed from austempered ductile iron, and have a preferred wall thickness of from about 0.25"-3.0", and more preferably, from about 0.6875" to about 2.25". According to some preferred embodiments, the bolster 16 is constructed so that at least one wall has a maximum thickness of about 0.6875". According to another preferred embodiment, the bolster 16 is constructed so that at least one wall has a maximum thickness of about 0.25". According to some preferred embodiments, the bolster 16 is constructed so that the walls have a maximum thickness of about 3.0". According to another preferred embodiment, the bolster 16 is constructed so that the walls have a maximum thickness of about 2.25". Other preferred embodiments include bolster embodiments where at least one wall has a maximum thickness of 0.25" and the remaining walls are within a thickness range where the maximum wall thickness for any walls is 3.0". Still other preferred embodiments include bolster embodiments where at least one wall has a maximum thickness of 0.25" and the remaining walls are within a thickness range where the maximum wall thickness for any walls is 2.25". According to yet other preferred embodiments, the bolster 16 has at least one wall with a maximum thickness of 0.6875" and the remaining walls are within a thickness range where the maximum wall thickness for any walls is 3.0". Still other preferred embodiments include bolster embodiments where at least one wall has a maximum thickness of 0.6875" and the remaining walls are within a thickness range where the maximum wall thickness for any walls is 2.25". The walls forming the bolster (e.g., the top wall 117, side walls 118 and web 126) may be constructed to have thicknesses within the ranges and preferred ranges discussed herein. According to some preferred embodiments, the walls forming the bolster 16 may have the same or different thicknesses from other walls forming the bolster 16.

According to preferred embodiments of the invention, sideframes, bolsters and trucks are constructed from an austempered metal, preferably austempered steel, austempered ductile iron, austempered steel alloy or austempered ductile iron alloy. Preferred compositions, such as steel, as well as alloy steel compositions, e.g., alloyed preferably with magnesium, manganese, molybdenum, copper or mixtures thereof, or more preferably, with chromium, nickel or mixtures thereof, (or mixtures of the preferred and more preferred metals), may be used to form the sideframes and bolsters (which are assembled to construct a railroad vehicle truck) as discussed herein. The steel or preferred/more preferred alloy steel composition is austempered to obtain tensile strength, yield, and elongation properties for the inventive sideframes and bolsters (and trucks constructed therefrom) which are suitable to meet or exceed the AAR standards for sideframes, bolsters and trucks, including the current standard set forth by the American Association of Railroads (AAR) in AAR Manual of Standards and Recommended Practices, such as Specification M-976 (truck performance for rail cars) and Rule 88 of the AAR Office Manual, the compete contents of which are herein incorporated by reference. Sideframes and bolsters (and trucks made from these components) may be constructed from ductile iron that is austempered. The ductile iron also may be used in alloy form, preferably, with nickel, molybdenum, manganese, copper, or mixtures thereof, and the ductile iron alloy austempered to form sideframes and bolsters. The sideframes and bolsters may be used to form rail car trucks. The sideframes and bolsters formed from austempered ductile iron and from the preferred austempered ductile iron alloys (as well as the trucks constructed from these sideframes and bolsters), meet or exceed the AAR standards, including the current standard M-976 and Rule 88 of the AAR Office Manual. Lightweight sideframes, bolsters and trucks are constructed from austempered ductile iron, austempered ductile iron alloy, austempered steel, and/or austempered steel alloy, in accordance with the invention, to provide sideframes, bolsters and/or trucks that are lighter in weight than prior sideframes and bolsters (and trucks constructed therefrom) yet possesses suitable strength, yield and elongation properties that meet or exceed AAR testing and standards requirements.

The foregoing description has been provided to clearly define and completely describe the present invention. Various modifications may be made without departing from the scope and spirit of the invention, which is defined in the following claims.

What is claimed is:

1. An improved railcar truck sideframe comprising:

a top flange;

a bottom flange;

a vertical web extending between said top flange and said bottom flange;

said sideframe having a first end and a second end, each said end having a pedestal jaw;

wherein said sideframe is constructed from austempered ductile iron; and wherein said sideframe is constructed from austempered ductile iron having a composition according to the following formula:

| Elements | Percentage | Range |
|---|---|---|
| C Carbon | 3.6% | +/−0.20% |
| Si Silicon | 2.5% | +/− 0.20% |
| Mg Magnesium | (% S × 0.76) + 0.025% | +/− 0.005% |
| Mn Manganese | | |
| Max. section > 1/2" | 0.35% maximum | +/− 0.05% |
| Max. section < 1/2" | 0.60% maximum | +/− 0.05% |
| Cu Cooper | 0.80% maximum | +/−0.05% |
| Ni Nickel | 2.00% maximum | +/− 0.10% |
| Mo Molybdenum | 0.30% maximum | +/− 0.03% |
| Sn Tin | 0.02% maximum | +/− 0.003% |
| Sb Antimony | 0.002% maximum | +/− 0.0003% |
| P Phosphorus | 0.02% maximum | |
| S Sulfur | 0.02% maximum | |
| O Oxygen | 50 ppm maximum | |
| Cr Chromium | 0.10% maximum | |
| Ti Titanium | 0.040% maximum | |

-continued

| Elements | Percentage | Range |
|---|---|---|
| V Vanadium | 0.10% maximum | |
| Al Aluminum | 0.050% maximum | |
| As Arsenic | 0.020% maximum | |
| Bi Bismuth | 0.002% maximum | |
| B Boron | 0.0004% maximum | |
| Cd Cadmium | 0.005% maximum | |
| Pb Lead | 0.002% maximum | |
| Se Selenium | 0.030% maximum | |
| Te Tellurium | 0.003% maximum | |
| Iron | Balance of formula. | |

2. The truck sideframe of claim 1, wherein said austempered ductile iron has an alloy content that is greater than 4.0%.

3. The truck sideframe of claim 2, wherein said austempered ductile iron comprises ductile iron alloyed with one or more metals selected from the group consisting of nickel, molybdenum, manganese, copper and mixtures thereof, wherein said ductile iron alloyed with said one or more metals is austempered to produce said sideframe.

4. The truck sideframe of claim 2, wherein said austempered ductile iron has a carbon equivalent (CE) value of 4.3 to 4.73.

5. The truck sideframe of claim 1, wherein said sideframe is constructed from austempered ductile iron having a carbon equivalent (CE) value of 4.3 to 4.73.

6. A railroad truck comprising a pair of sideframes of claim 1, and a bolster, arranged together in a configuration to form a truck, said bolster and said sideframes being constructed from austempered ductile iron having an alloy content that is greater than 4.0% and a carbon equivalent (CE) value of 4.3 to 4.73.

7. The railroad truck of claim 6, wherein said bolster is constructed from austempered ductile iron having a minimum tensile strength of between about 130 ksi and 190 ksi, a minimum yield strength of between about 90 ksi to 160 ksi, a minimum elongation in 2 inches of 2% to 7%.

8. The railroad truck of claim 7, wherein said austempered ductile iron comprises ductile iron alloyed with one or more metals selected from the group consisting of nickel, molybdenum, manganese, copper and mixtures thereof, wherein said ductile iron alloyed with said one or more metals is austempered to produce said bolster and sideframes; and wherein said austempered ductile iron has a minimum tensile strength of 190 ksi, a minimum yield strength of 160 ksi, and a minimum elongation in 2 inches of 7%.

9. The railroad truck of claim 6, wherein said bolster has a bolster top wall, two sidewalls, and a web disposed between said bolster sidewalls and below said bolster top wall, said bolster web connecting said bolster top wall and said bolster sidewalls at locations along said bolster web, wherein said bolster top wall, said bolster sidewalls and said bolster web have thicknesses between 0.25"-3.0".

10. The railroad truck of claim 9, wherein said bolster top wall, said bolster sidewalls and said bolster web have thicknesses between 0.6875" to 2.25".

11. The railroad truck of claim 9, wherein at least one of said bolster top wall, said bolster sidewalls or said bolster web has a maximum thickness of 0.25".

12. The railroad truck of claim 10, wherein at least one of said bolster top wall, said bolster sidewalls or said bolster web has a maximum thickness of 0.6875".

13. The railroad truck of claim 12, wherein each of said bolster top wall, said bolster sidewalls and said bolster web has a maximum thickness of 2.25".

14. The railroad truck of claim 6, wherein said bolster has a top wall, two sidewalls, and a web disposed between said bolster sidewalls and below said bolster top wall, said bolster web connecting said top wall and said bolster sidewalls at locations along said bolster web, and wherein said bolster sidewalls, said bolster top wall and said bolster web have a maximum thicknesses of 3.0".

15. The railroad truck of claim 14, wherein each of said bolster top wall, said bolster sidewalls and said bolster web has a maximum thickness of 2.25".

16. The railroad truck of claim 6, wherein said bolster is constructed from austempered ductile iron having a composition according to the following formula

| | |
|---|---|
| Carbon | 3.60-3.80% |
| Silicon | <2.60%; |
| Copper | 0.50-0.70% |
| Manganese | 0.35-0.45% |
| Nickel | <0.03% |
| Chromium | <0.05% |
| Magnesium | 0.030-0.050% |
| Iron | balance of the composition. |

17. The railroad truck of claim 6, wherein said bolster is constructed from austempered ductile iron having a composition according to the following formula:

| Elements | Percentage | Range |
|---|---|---|
| C Carbon | 3.6% | +/−0.20% |
| Si Silicon | 2.5% | +/− 0.20% |
| Mg Magnesium | (% S × 0.76) + 0.025% | +/− 0.005% |
| Mn Manganese | | |
| Max. section > 1/2" | 0.35% maximum | +/− 0.05% |
| Max. section < 1/2" | 0.60% maximum | +/− 0.05% |
| Cu Cooper | 0.80% maximum | +/− 0.05% |
| Ni Nickel | 2.00% max. | +/− 0.10% |
| Mo Molybdenum | 0.30% max. | +/− 0.03% |
| Sn Tin | 0.02% max. | +/− 0.003% |
| Sb Antimony | 0.002% max. | +/− 0.0003% |
| P Phosphorus | 0.02% maximum | |
| S Sulfur | 0.02% maximum | |
| O Oxygen | 50 ppm maximum | |
| Cr Chromium | 0.10% maximum | |
| Ti Titanium | 0.040% maximum | |
| V Vanadium | 0.10% maximum | |
| Al Aluminum | 0.050% maximum | |
| As Arsenic | 0.020% maximum | |
| Bi Bismuth | 0.002% maximum | |
| B Boron | 0.0004% maximum | |
| Cd Cadmium | 0.005% maximum | |
| Pb Lead | 0.002% maximum | |
| Se Selenium | 0.030% maximum | |
| Te Tellurium | 0.003% maximum | |
| Iron | Balance of formula. | |

18. The railroad truck of claim 17, wherein said austempered ductile iron composition of said bolster further includes a post inoculant.

19. The railroad truck of claim 18, wherein said post inoculant of said bolster austempered ductile iron composition is selected from the group consisting of La, Ca, S and O, and mixtures thereof.

20. The railroad truck of claim 19, wherein said austempered ductile iron of said bolster comprises molten ductile iron and alloys in accordance with said bolster austempered ductile iron formula, wherein said post inoculant of said bolster austempered ductile iron composition is introduced to said molten ductile alloy and alloys, and wherein said bolster is a casting of austempered inoculated ductile iron.

21. The railroad truck of claim 20, wherein said bolster has a minimum nodule count of 100 per mm2.

22. The railroad truck of claim 20, wherein said bolster has a minimum nodularity of 90%.

23. The railroad truck of claim 20, wherein said bolster has a minimum nodule count of 100 per mm2 and a minimum nodularity of 90%.

24. The railroad truck of claim 23, wherein said post inoculant of said bolster austempered ductile iron composition is selected from the group consisting of La, Ca, S and O, and mixtures thereof.

25. The railroad truck of claim 23, wherein said bolster has a top wall, two sidewalls, and a web disposed between said bolster sidewalls and below said bolster top wall, said bolster web connecting said bolster top wall and said bolster sidewalls at locations along said bolster web, and wherein said bolster top wall, said bolster sidewalls, and said bolster web have thicknesses between 0.25"-3.0".

26. The railroad truck of claim 25, wherein said bolster sidewalls, said bolster top wall, and said bolster web have thicknesses between 0.6875" to 2.25".

27. The railroad truck of claim 25, wherein at least one of said bolster top wall, said bolster sidewall and said bolster web has a maximum thickness of 0.25".

28. The railroad truck of claim 26, wherein at least one of said bolster top wall, said bolster sidewall and said bolster web has a maximum thickness of 0.6875".

29. The railroad truck of claim 27, wherein each of said bolster top wall, said bolster sidewalls and said bolster web has a maximum thickness of 2.25".

30. The railroad truck of claim 23, wherein said bolster has a top wall, two sidewalls, and a web disposed between said bolster sidewalls and below said bolster top wall, said bolster web connecting said bolster top wall and said bolster sidewalls at locations along said bolster web, and wherein said bolster top wall, said bolster sidewalls, and said bolster web each have a maximum thickness of 3.0".

31. The railroad truck of claim 30, wherein each of said bolster top wall, said bolster sidewalls and said bolster web has a maximum thickness of 2.25".

32. The railroad truck of claim 23, the bolster having a minimum tensile strength of between about 130 ksi and 190 ksi, a minimum yield strength of between about 90 ksi to 160 ksi, a minimum elongation in 2 inches of 2% to 7%.

33. The sideframe of claim 1, wherein said sideframe has a spring shelf, wherein said sideframe has walls defining each of said top flange, said bottom flange, said vertical webs, said spring shelf, and said pedestal jaw, and wherein said walls have wall thicknesses between 0.25" to 2.5".

34. The sideframe of claim 33, wherein said top flange, said bottom flange, said vertical webs, said spring shelf, and said pedestal jaw, have wall thicknesses between 0.375" to 1.75".

35. The sideframe of claim 33, wherein at least one wall has a maximum thickness of 0.25".

36. The sideframe of claim 34, wherein at least one wall has a maximum thickness of 0.375".

37. The sideframe of claim 33, wherein said walls have a maximum thickness of 1.75".

38. The sideframe of claim 1, wherein said sideframe has walls defining each of said top flange, said bottom flange, said vertical webs, and said pedestal jaw, wherein said walls have a maximum thickness of 2.5".

39. The sideframe of claim 38, wherein said walls have a maximum thickness of 1.75".

40. The sideframe of claim 1, wherein said austempered ductile iron composition further includes a post inoculant.

41. The sideframe of claim 40, wherein said post inoculant is selected from the group consisting of La, Ca, S and O, and mixtures thereof.

42. The sideframe of claim 40, wherein said austempered ductile iron comprises molten ductile iron and alloys in accordance with said formula, wherein said post inoculant is introduced to said molten ductile alloy and alloys, and wherein said sideframe is a casting of austempered inoculated ductile iron.

43. The sideframe of claim 42, wherein said sideframe has a minimum nodule count of 100 per mm2.

44. The sideframe of claim 42, wherein said sideframe has a minimum nodularity of 90%.

45. The sideframe of claim 42, wherein said sideframe has a minimum nodule count of 100 per mm2 and a minimum nodularity of 90%.

46. The sideframe of claim 45, wherein said post inoculant is selected from the group consisting of La, Ca, S and O, and mixtures thereof.

47. The sideframe of claim 45, wherein said sideframe has a spring shelf, wherein said sideframe has walls defining each of said top flange, said bottom flange, said vertical webs, said spring shelf, and said pedestal jaw, and wherein said walls have wall thicknesses between 0.25"-2.5".

48. The sideframe of claim 45, wherein said sideframe has walls defining each of said top flange, said bottom flange, said vertical webs, and said pedestal jaw, wherein said walls have a maximum thickness of 2.5".

49. The sideframe of claim 45, having a minimum tensile strength of between about 130 ksi and 190 ksi, a minimum yield strength of between about 90 ksi to 160 ksi, a minimum elongation in 2 inches of 2% to 7%.

50. An improved railcar truck including:

a pair of sideframes, wherein each sideframe is a sideframe according to claim 1, wherein said sideframe is constructed from an austempered metal selected from the group consisting of austempered ductile iron, austempered steel, austempered metal alloys, and mixtures thereof;

wherein said sideframe has a wall thickness between 0.25" and 2.5"; and a bolster.

51. An improved railcar truck including:

a bolster, wherein said bolster is constructed from an austempered metal selected from the group consisting of austempered ductile iron, austempered steel, austempered metal alloys, and mixtures thereof;

wherein said bolster has a preferred wall thickness between 0.25" and 3.0"; and a pair of sideframes connected to said bolster, wherein each sideframe is a sideframe according to claim 1.

52. An improved railcar truck, comprising:

an assembly of a pair of sideframes of claim 1 and a bolster.

53. An improved railcar truck including:

a) a pair of sideframes, wherein each sideframe is a sideframe according to claim 1, b) a bolster comprising:

a box-shaped body with a top wall and interconnecting side walls;

a pin receptor centrally located in said top wall;

two distal ends that extend outwardly of said body at a distance from said receptor; each distal end having substantially flat horizontal, surfaces adapted to directly carry a rail car body wherein said bolster is arranged with one of the said pair of sideframes respectively connected at each bolster distal end, and wherein each said distal end that extends outwardly of said body at a distance from said receptor extends beyond the respective side frame to which it is connected; and wherein said bolster is constructed from austempered ductile iron having a composition according to the following formula:

| Elements | Percentage | Range |
|---|---|---|
| C Carbon | 3.6% | +/−0.20% |
| Si Silicon | 2.5% | +/− 0.20% |
| Mg Magnesium | (% S × 0.76) + 0.025% | +/− 0.005% |
| Mn Manganese | | |
| Max. section > 1/2" | 0.35% maximum | +/− 0.05% |
| Max. section < 1/2" | 0.60% maximum | +/− 0.05% |
| Cu Cooper | 0.80% maximum | +/− 0.05% |
| Ni Nickel | 2.00% max. | +/− 0.10% |
| Mo Molybdenum | 0.30% max. | +/− 0.03% |
| Sn Tin | 0.02% max. | +/− 0.003% |
| Sb Antimony | 0.002% max. | +/− 0.0003% |
| P Phosphorus | 0.02% maximum | |
| S Sulfur | 0.02% maximum | |
| O Oxygen | 50 ppm maximum | |
| Cr Chromium | 0.10% maximum | |
| Ti Titanium | 0.040% maximum | |
| V Vanadium | 0.10% maximum | |
| Al Aluminum | 0.050% maximum | |
| As Arsenic | 0.020% maximum | |
| Bi Bismuth | 0.002% maximum | |
| B Boron | 0.0004% maximum | |
| Cd Cadmium | 0.005% maximum | |
| Pb Lead | 0.002% maximum | |
| Se Selenium | 0.030% maximum | |
| Te Tellurium | 0.003% maximum | |
| Iron | Balance of formula. | |

54. The truck of claim 53, wherein said austempered ductile iron has an alloy content that is greater than 4.0%.

55. The truck of claim 54, wherein said austempered ductile iron has a carbon equivalent (CE) value of 4.3 to 4.6.

56. An improved railcar truck sideframe comprising:

a top flange;

a bottom flange;

a vertical web extending between said top flange and said bottom flange;

said sideframe having a first end and a second end, each said end having a pedestal jaw;

wherein said sideframe is constructed from austempered ductile iron;

wherein said austempered ductile iron has an alloy content that is greater than 4.0%;

wherein said austempered ductile iron has a carbon equivalent (CE) value of 4.37 to 4.73; and wherein said sideframe is constructed from austempered ductile iron having a composition according to the following formula:

| | |
|---|---|
| Carbon | 3.60-3.80% |
| Silicon | <2.60%; |
| Copper | 0.50-0.70% |
| Manganese | 0.35-0.45% |
| Nickel | <0.03% |
| Chromium | <0.05% |
| Magnesium | 0.030-0.050% |
| Iron | balance of the composition. |

57. The sideframe of claim 56, wherein said sideframe walls have wall thicknesses between 0.375" to 1.75".

58. The sideframe of claim 56, wherein at least one of said walls has a maximum thickness of 0.25".

59. The sideframe of claim 57, wherein at least one of said walls has a maximum thickness of 0.375".

60. The sideframe of claim 25, wherein said walls have a maximum thickness of 1.75".

61. The sideframe of claim 58, wherein said walls have a maximum thickness of 1.75".

* * * * *